US008903285B2

(12) United States Patent
Hatano

(10) Patent No.: US 8,903,285 B2
(45) Date of Patent: Dec. 2, 2014

(54) IMAGE FORMING APPARATUS INCLUDING PRE-TRANSFER NEUTRALIZATION UNIT TO ADJUST POTENTIAL DIFFERENCE BETWEEN NON-IMAGE AND SOLID IMAGE REGIONS OF THE IMAGE CARRYING BODY

(71) Applicant: KYOCERA Document Solutions Inc., Osaka (JP)

(72) Inventor: Masaru Hatano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 25 days.

(21) Appl. No.: 13/752,883

(22) Filed: Jan. 29, 2013

(65) Prior Publication Data

US 2013/0195488 A1 Aug. 1, 2013

(30) Foreign Application Priority Data

Jan. 30, 2012 (JP) ..... 2012-016319

(51) Int. Cl.
*G03G 15/16* (2006.01)
*G03G 15/01* (2006.01)
*G03G 21/08* (2006.01)

(52) U.S. Cl.
CPC ..... *G03G 15/169* (2013.01); *G03G 15/0189* (2013.01); *G03G 21/08* (2013.01)
USPC ..... 399/296; 399/66; 399/128

(58) Field of Classification Search
USPC ..... 399/66, 296, 128–129, 31
See application file for complete search history.

(56) References Cited

U.S. PATENT DOCUMENTS 4,538,901 A * 9/1985 Soumiya ..... 399/128
5,333,037 A * 7/1994 Inoue et al. ..... 399/49
5,371,579 A * 12/1994 Bisaiji ..... 399/44
5,508,787 A * 4/1996 Hasegawa et al. ..... 399/31
5,530,525 A * 6/1996 Tsujita et al. ..... 399/343
5,534,980 A * 7/1996 Tanaka ..... 399/168
5,966,560 A * 10/1999 Kodama et al. ..... 399/66

(Continued)

FOREIGN PATENT DOCUMENTS

JP 02008875 A * 1/1990 ..... G03G 15/16
JP 2003-263036 A 9/2003

(Continued)

OTHER PUBLICATIONS

Notice of Reasons for Rejection issued to JP Application No. 2012-016319 mailed Jul. 16, 2013.

*Primary Examiner* — G. M. Hyder
(74) *Attorney, Agent, or Firm* — Knobbe Martens Olson & Bear LLP

(57) ABSTRACT

The cleaning unit cleans the surface of the image carrying body after transfer of the toner image onto an image transfer object. The post-transfer neutralization unit is disposed between the transfer unit and the cleaning unit, and neutralizes electrical charge of the surface of the image carrying body after transfer. The first control unit controls neutralization light intensity of the pre-transfer neutralization unit such that a dark potential ($V_0$ potential) of a non-image region on the image carrying body after pre-transfer neutralization is higher by 50 to 150 V than a bright potential ($V_L$ potential) of a solid image region. The first setting operating unit allows for an increase and decrease in the neutralization light intensity of the pre-transfer neutralization unit based on a status of an output image.

1 Claim, 4 Drawing Sheets

(56) References Cited

U.S. PATENT DOCUMENTS

| | | | | |
|---|---|---|---|---|
| 6,021,300 | A * | 2/2000 | Jeong | 399/296 |
| 6,324,373 | B1 * | 11/2001 | Park | 399/296 |
| 7,319,835 | B2 * | 1/2008 | Ahn | 399/129 |
| 7,684,717 | B2 * | 3/2010 | Izumi et al. | 399/44 |
| 7,894,749 | B2 * | 2/2011 | Jung et al. | 399/128 |
| 8,005,380 | B2 * | 8/2011 | Kubo | 399/50 |
| 8,107,858 | B2 * | 1/2012 | Okabe | 399/128 |
| 8,682,220 | B2 * | 3/2014 | Miyaji | 399/128 |
| 2004/0005170 | A1 * | 1/2004 | Ahn | 399/128 |
| 2004/0126148 | A1 * | 7/2004 | Iwai et al. | 399/296 |
| 2008/0159783 | A1 * | 7/2008 | Jung et al. | 399/128 |
| 2009/0028591 | A1 * | 1/2009 | Kubo | 399/50 |
| 2011/0096452 | A1 * | 4/2011 | Miyaji | 361/212 |
| 2011/0249987 | A1 * | 10/2011 | Ishino et al. | 399/128 |
| 2013/0136499 | A1 * | 5/2013 | Kamiyama | 399/128 |
| 2014/0029964 | A1 * | 1/2014 | Shibuya | 399/44 |

FOREIGN PATENT DOCUMENTS

| | | | |
|---|---|---|---|
| JP | 2010-145472 | A | 7/2010 |
| JP | 2011-027916 | A | 2/2011 |
| JP | 2011-221405 | A | 11/2011 |

* cited by examiner

IMAGE FORMING APPARATUS INCLUDING PRE-TRANSFER NEUTRALIZATION UNIT TO ADJUST POTENTIAL DIFFERENCE BETWEEN NON-IMAGE AND SOLID IMAGE REGIONS OF THE IMAGE CARRYING BODY

INCORPORATION BY REFERENCE

This application is based upon and claims the benefit of priority from the corresponding Japanese Patent Application No. 2012-016319, filed in the Japan Patent Office on Jan. 30, 2012, the entire contents of which are incorporated herein by reference.

BACKGROUND

The present disclosure relates to an image forming apparatus employing xerography, such as a copy machine and a printer.

RELATED ART

In the image forming apparatus employing xerography, an image is formed by repeating the following cycle:

the surface of an image carrying body (photoconductor drum) is charged at a predetermined potential;

exposure is performed to form an electrostatic latent image on the surface of the image carrying body;

a toner image is formed by developing the electrostatic latent image on the surface of the image carrying body by a developing unit;

the toner image is transferred to an image transfer object such as paper; and the surface of the image carrying body is cleaned after transfer by a cleaning unit that is in contact with the surface of the image carrying body.

In image forming apparatuses employing xerography, a charging system (charging roller system) that charges the surface of the image carrying body at a predetermined positive potential is widely applied in order to reduce ozone generation, thereby curbing the deterioration in the environment of the installation site of the apparatus in an office or the like. In the image forming apparatus adopting such a charging roller system, constant current control, in which the voltage to be applied to a transfer unit upon transfer is controlled by constant current, is generally employed for providing a superior transfer performance that allows stable transfer of the toner image formed on the surface of the image carrying body onto the image transfer object.

However, with regard to an image region that is a part of the surface of the image carrying body where a toner image is formed and a non-image region that is a part of the surface of the image carrying body where no toner image is formed, upon applying the transfer potential to the transfer unit by constant current control, a potential difference between the non-image region and the transfer unit is greater than the potential difference between the image region and the transfer unit. As a result, little of the current flows into the image region while much of the current flows into the non-image region. This may lead to inappropriate transfer of the toner image and transfer defect. In order to prevent this defect, it has been considered to improve the transfer performance by increasing the transfer current. However, if the transfer current is increased, the difference between intensities of the current flowing into the non-image region and the current flowing into the image region becomes even greater. As a result, transfer memory (charge memory) is generated due to a difference in charging characteristics on the surface of the image carrying body. This may cause an image defect in the following image formation, such as a trace of a previous image.

As a technique for reducing the occurrence of transfer defects causing image defects, an image forming apparatus (prior art) has been proposed that is provided with a pre-transfer neutralization unit that performs a neutralization process on the surface of an image carrying body by making the potential of at least a part of a non-image region in the surroundings of an image region of the image carrying body higher than that of an image region toward the same polarity as the charging characteristics of the toner, prior to transfer.

In the image forming apparatus of the prior art, a toner image can be transferred to an image transfer object, while suppressing scattering of the toner in the vicinity of an edge of the image region on the surface of the image carrying body by way of the influence of the potential of the non-image region being present in the vicinity of the edge of the image region. As a result, the transfer performance can be improved.

In the image forming apparatus of the prior art, a potential difference between the image region and the non-image region can be reduced by performing the pre-transfer neutralization. However, generation of transfer memory due to a difference in influx amount of the transfer current between the image region and the non-image region cannot be sufficiently reduced. Especially in the charging roller system, the charging ability of the image carrying body is low, and thus the occurrence of causes transfer memory is considerable, whereby image defects tend to occur.

The present disclosure has an object of providing an image forming apparatus employing the charging system that is preferable for an improvement in the environment, while being able to achieve an improvement in the transfer performance by suppressing scattering of the toner, as well as being able to form high-quality images by sufficiently suppressing the occurrence of transfer memory due to a difference in the influx amount of transfer current.

SUMMARY

The present disclosure is an image forming apparatus including an image carrying body, a charging unit, an exposure unit, a developing unit, a transfer unit, a pre-transfer neutralization unit, a cleaning unit, a post-transfer neutralization unit, a first control unit, a second control unit, and a first setting operating unit. The image carrying body rotates about an axis of rotation and carries a toner image on a surface thereof. The charging unit is disposed to face the surface of the image carrying body and electrically charges the surface of the image carrying body at a predetermined positive potential. The exposure unit exposes the surface of the image carrying body having been electrically charged by the charging unit to thereby form an electrostatic latent image on the surface. The developing unit forms a toner image on the surface of the image carrying body by developing the electrostatic latent image. The transfer unit is disposed in contact with the surface of the image carrying body through an image transfer object and transfers the toner image onto the image transfer object by applying a predetermined transfer potential. The pre-transfer neutralization unit that is disposed between the developing unit and the transfer unit, and neutralizes electrical charge of the surface of the image carrying body prior to transfer. The cleaning unit contacts the surface of the image carrying body after transfer of the toner image onto the image transfer object to thereby clean the surface of the image carrying body. The post-transfer neutralization unit is disposed between the transfer unit and the cleaning unit, and neutralizes electrical charge of the surface of the image carrying body after transfer. The first control unit controls neutralization light intensity of the pre-transfer neutralization unit such that a dark potential ($V_0$ potential) of a non-image region on the image carrying body after pre-transfer neutralization is higher by 50 to 150 V than a bright potential ($V_L$ potential) of a solid image region. The second control unit controls the transfer potential of the transfer unit. The first setting operating unit allows for an increase and decrease in the neutralization light intensity of the pre-transfer neutralization unit based on a status of an output image.

DETAILED DESCRIPTION

Figure 1:
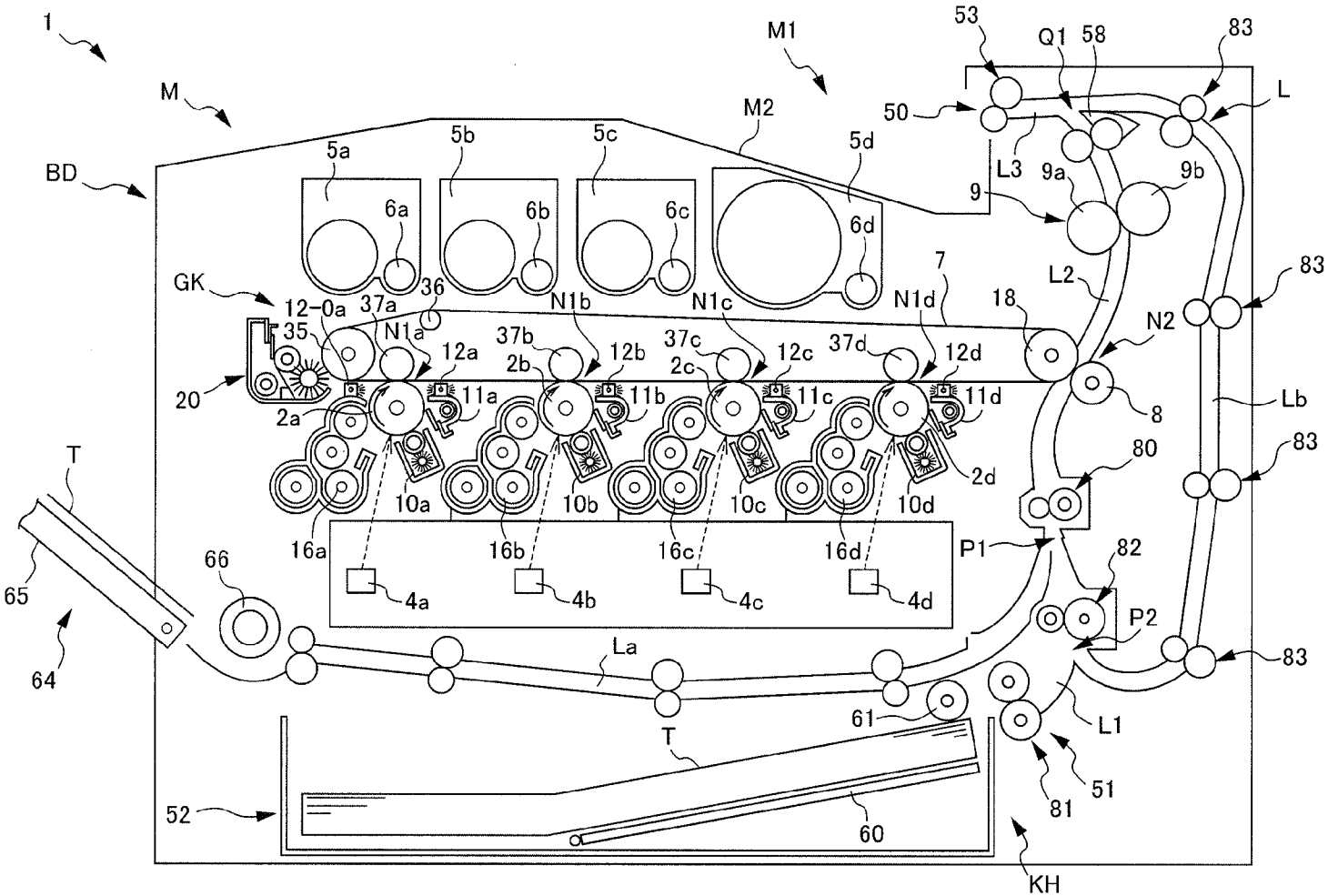
FIG. 1 is a diagram illustrating the arrangement of components of a printer 1 according to an embodiment of the present disclosure.
Figure 2:
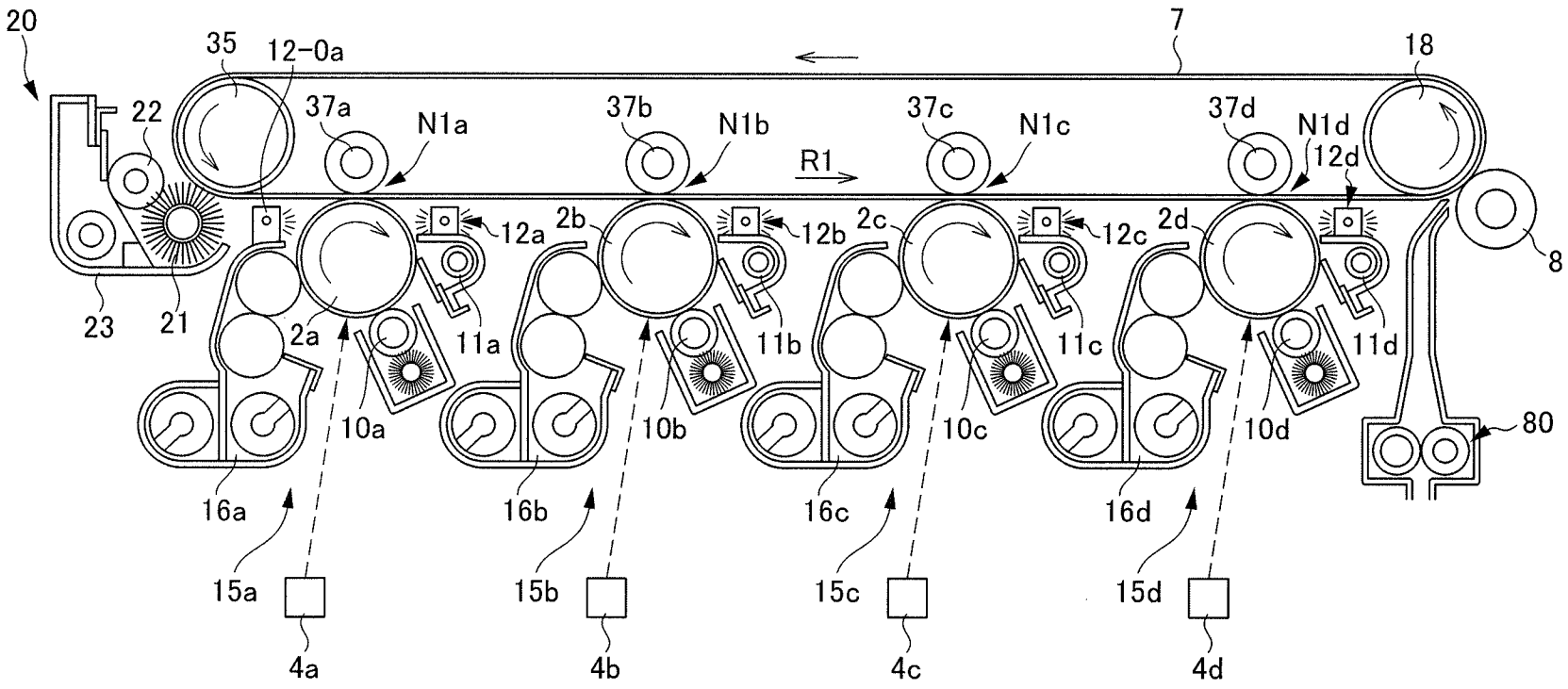
FIG. 2 is a vertical cross-sectional view illustrating a configuration of an image forming portion GK in the printer 1 according to the embodiment.

An embodiment of an image forming apparatus according to the present disclosure will be described hereinafter with reference to the drawings. An overall structure of the printer 1 serving as an embodiment of the image forming apparatus according to the present disclosure will be described with reference to FIGS. 1 and 2. FIG. 1 is a diagram illustrating the arrangement of components of the printer 1 according to the embodiment of the present disclosure. FIG. 2 is a vertical cross-sectional view illustrating a configuration of an image forming portion GK in the printer 1 according to the embodiment.

As shown in FIG. 1, the printer 1 as the image forming apparatus includes an apparatus main body M, an image forming portion GK, and a paper feeding/discharging unit KH. The image forming portion GK forms a predetermined toner image on paper T, as a sheet-shaped transfer material, based on predetermined image information. The paper feeding/discharging unit KH feeds the paper T to the image forming portion GK and discharges the paper T on which the toner image is formed. An external shape of the apparatus main body M is composed of a casing body BD as a housing.

As shown in FIGS. 1 and 2, the image forming portion GK includes: a circular intermediate transfer belt 7, which is an endless belt rotating in a predetermined direction indicated by an arrow in FIG. 2; four image forming units 15*a*, 15*b*, 15*c*, 15*d*; a belt cleaning unit 20; a secondary transfer roller 8; an opposing roller 18; and a fixing unit 9. The four image forming units 15*a*, 15*b*, 15*c*, 15*d* are aligned in the rotational direction R1 of the intermediate transfer belt 7 from an upstream side (left side in FIG. 1) to a downstream side (right side in FIG. 1) thereof, at intervals in the rotational direction R1 of the intermediate transfer belt 7.

The four image forming units 15*a*, 15*b*, 15*c*, 15*d* are: the image forming unit 15*a* for yellow, the image forming unit 15*b* for cyan, the image forming unit 15*c* for magenta, and the image forming unit 15*c* for black, in this order from the upstream side.

The belt cleaning unit 20 is disposed on an outer face side of the intermediate transfer belt 7, to face the upstream side of the four image forming units 15*a*, 15*b*, 15*c*, 15*d* in the rotational direction R1 of the intermediate transfer belt 7. The belt cleaning unit 20 removes the residual toner remaining on the intermediate transfer belt 7. The belt cleaning unit 20 includes: a rotational brush 21 that rotates in contact with the intermediate transfer belt 7; a rotational roller 22 that sweeps away the residual toner scraped off by the rotational brush 21; and a residual toner container 23 that receives the residual toner thus swept.

The four image forming units 15*a*, 15*b*, 15*c*, 15*d* include: photoconductor drums 2*a*, 2*b*, 2*c*, and 2*d* as image carrying bodies (photoreceptors); charging units 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding units 6*a*, 6*b*, 6*c*, and 6*d*; cleaning units 11*a*, 11*b*, 11*c*, and 11*d*; and neutralization units 12-0*a*, 12*a*, 12*b*, 12*c*, and 12*d*.

As shown in FIG. 1, the paper feeding/discharging portion KH includes a paper feeding cassette 52, a manual feeding portion 64, a paper feed path L for the paper T, a registration roller pair 80, a plurality of rollers or roller pairs, and a discharging portion 50. It should be noted that, as described later, the paper feed path L is an assembly of a first paper feed path L1, a second paper feed path L2, a third paper feed path L3, a manual paper feed path La, and a reverse paper feed path Lb.

Configurations of the four image forming units 15*a*, 15*b*, 15*c*, 15*d* and the paper feeding/discharging unit KH of the image forming portion GK are described in detail hereinafter. First, the image forming units 15*a*, 15*b*, 15*c*, and 15*d* of the image forming portion GK are described.

In the image forming units 15*a*, 15*b*, 15*c*, and 15*d*, performed on a surface of the photoconductor drums 2*a*, 2*b*, 2*c* and 2*d* are: charging by the charging portions 10*a*, 10*b*, 10*c* and 10*d*; exposure by the laser scanner units 4*a*, 4*b*, 4*c* and 4*d*; development by the developing units 16*a*, 16*b*, 16*c* and 16*d*; primary transfer by the intermediate transfer belt 7 and the primary transfer rollers 37*a*, 37*b*, 37*c* and 37*d*; static neutralization by the neutralization units 12-0*a*, 12*a*, 12*b*, 12*c* and 12*d*; and cleaning by the cleaning units 11*a*, 11*b*, 11*c* and 11*d*, from an upstream side to a downstream side. In addition, secondary image transfer by the intermediate transfer belt 7, the secondary transfer roller 8 and the opposing roller 18, and fixation by the fixing unit 9 are performed in the image forming portion GK.

Each of the photoconductor drums 2*a*, 2*b*, 2*c*, and 2*d* is composed of a cylindrically shaped member and function as a photoreceptor or an image carrying body. The photoconductor drums 2*a*, 2*b*, 2*c*, and 2*d* are disposed to face primary transfer positions (described later) on the side of the outer face of the intermediate transfer belt 7 respectively. Each of the photoconductor drums 2*a*, 2*b*, 2*c*, and 2*d* is disposed so as to be rotatable in a direction of an arrow, about an axis that extends in a direction orthogonal to a direction of movement of the intermediate transfer belt 7. An electrostatic latent image can be formed on a surface of each of the photoconductor drums 2*a*, 2*b*, 2*c*, and 2*d*.

The charging portions 10*a*, 10*b*, 10*c*, and 10*d* are disposed so as to face a surface of the photoconductor drums 2*a*, 2*b*, 2*c*, and 2*d*, respectively. The charging portions 10*a*, 10*b*, 10*c*, and 10*d* are composed of charging rollers that rotate in contact with surfaces of the photoconductor drums 2*a*, 2*b*, 2*c*, and 2*d*, respectively. The charging portions 10*a*, 10*b*, 10*c*, and 10*d* uniformly positively charge (straight polarity, positive potential) the surfaces of the photoconductor drums 2*a*, 2*b*, 2*c*, and 2*d*, respectively.

The laser scanner units 4*a*, 4*b*, 4*c*, and 4*d*, which function as the exposure units, are disposed to be spaced apart from a surface of the photoconductor drums 2*a*, 2*b*, 2*c*, and 2*d*, respectively. The laser scanner units 4*a*, 4*b*, 4*c*, and 4*d* include, respectively, a laser light source, a polygon mirror, a polygon mirror driving motor and the like, which are not illustrated.

The laser scanner units 4*a*, 4*b*, 4*c*, and 4*d* respectively scan and expose the surface of the photoconductor drums 2*a*, 2*b*, 2*c*, and 2*d* that are charged by the charging units 10*a*, 10*b*, 10*c* and 10*d*, based on image information input from an external device such as a PC (personal computer). An electric charge of an exposed part of the surface of each of the photoconductor drums 2*a*, 2*b*, 2*c*, and 2*d* is removed, which are scanned and exposed by the laser scanner units 4*a*, 4*b*, 4*c*, and 4*d*, respectively. In this way, an electrostatic latent image is formed on a surface of each of the photoconductor drums 2*a*, 2*b*, 2*c*, and 2*d*.

The developing units 16*a*, 16*b*, 16*c*, and 16*d* are disposed to correspond to the photoconductor drums 2*a*, 2*b*, 2*c*, and 2*d*, respectively, facing corresponding surfaces of the photoconductor drums 2*a*, 2*b*, 2*c*, and 2*d*. The developing units 16*a*, 16*b*, 16*c*, and 16*d* form toner images respectively on the photoconductor drums 2*a*, 2*b*, 2*c*, and 2*d*, by developing the electrostatic latent images. More specifically, the developing units 16*a*, 16*b*, 16*c*, and 16*d* form color toner images on surfaces of respective photoconductor drums 2*a*, 2*b*, 2*c*, and 2*d* by depositing toners of various colors on the electrostatic latent images formed on the surface of the photoconductor drums 2*a*, 2*b*, 2*c*, and 2*d*. The developing units 16*a*, 16*b*, 16*c*, and 16*d* correspond to four colors: yellow, cyan, magenta, and black, respectively. The developing units 16*a*, 16*b*, 16*c*, and 16*d* include developing rollers that are disposed to face the surfaces of the photoconductor drums 2*a*, 2*b*, 2*c*, and 2*d*, agitation rollers for agitating toners, respectively, and the like.

The toner cartridges 5*a*, 5*b*, 5*c*, and 5*d* are provided corresponding to the developing units 16*a*, 16*b*, 16*c*, and 16*d*, respectively, and store the toners of different colors that are supplied to the developing units 16*a*, 16*b*, 16*c*, and 16*d*, respectively. The toner cartridges 5*a*, 5*b*, 5*c*, and 5*d* store toners of yellow, cyan, magenta, and black respectively.

The toner feeding portions 6*a*, 6*b*, 6*c*, and 6*d* are provided correspondingly to the toner cartridges 5*a*, 5*b*, 5*c*, and 5*d* and the developing units 16*a*, 16*b*, 16*c*, and 16*d*, respectively. The toner feeding portions 6*a*, 6*b*, 6*c*, and 6*d* supply the toners of the colors stored in the toner cartridges 5*a*, 5*b*, 5*c*, and 5*d* to the developing units 16*a*, 16*b*, 16*c*, and 16*d*, respectively. The toner feeding apparatuses 6*a*, 6*b*, 6*c*, and 6*d* are connected with the developing units 16*a*, 16*b*, 16*c*, and 16*d*, respectively, via toner feeding paths (not illustrated).

Toner images of respective colors formed on the photoconductor drums 2*a*, 2*b*, 2*c*, and 2*d* are primarily transferred in sequence to the intermediate transfer belt 7. The intermediate transfer belt 7 is stretched around a driven roller 35, the opposing roller 18 consisting of a driving roller, a tension roller 36 (not illustrated in FIG. 2) and the like. As the tension roller 36 biases the intermediate transfer belt 7 from inside to outside, a predetermined tension is applied to the intermediate transfer belt 7.

The primary transfer rollers 37*a*, 37*b*, 37*c*, and 37*d* are arranged to face the photoconductor drums 2*a*, 2*b*, 2*c*, and 2*d*, respectively, across the intermediate transfer belt 7. The primary transfer rollers 37*a*, 37*b*, 37*c*, and 37*d* are composed of transfer rollers that rotate in contact with surfaces of the photoconductor drums 2*a*, 2*b*, 2*c*, and 2*d*, respectively, through the intermediate transfer belt 7. The primary transfer rollers 37*a*, 37*b*, 37*c*, and 37*d* are arranged in contact with surfaces of the photoconductor drums 2*a*, 2*b*, 2*c*, and 2*d*, respectively, through the intermediate transfer belt 7, and apply a predetermined transfer potential to transfer the toner images to the intermediate transfer belt 7.

Predetermined parts of the intermediate transfer belt 7 are sandwiched between the primary transfer rollers 37*a*, 37*b*, 37*c*, and 37*d* and the photoconductor drums 2*a*, 2*b*, 2*c*, and 2*d*. The sandwiched parts are pressed against surfaces of the photoconductor drums 2*a*, 2*b*, 2*c*, and 2*d*. Primary transfer nips N1*a*, N1*b*, N1*c*, and N1*d* are thus formed between the photoconductor drums 2*a*, 2*b*, 2*c*, and 2*d* and the primary transfer rollers 37*a*, 37*b*, 37*c*, and 37*d*, respectively. On each of the primary transfer nips N1*a*, N1*b*, N1*c*, and N1*d*, the toner images of the colors developed on the photoconductor drums 2*a*, 2*b*, 2*c*, and 2*d* are primarily transferred sequentially to the intermediate transfer belt 7. In this manner, a full-color toner image is formed on the intermediate transfer belt 7.

A primary transfer bias is applied to each of the primary transfer rollers 37*a*, 37*b*, 37*c*, and 37*d* by a primary transfer bias application portion (not shown). The primary transfer bias is a bias for transferring the toner images of the colors formed respectively on the photoconductor drums 2*a*, 2*b*, 2*c*, and 2*d* to the intermediate transfer belt 7.

The neutralization units 12-0*a*, 12*a*, 12*b*, 12*c*, and 12*d* are disposed so as to face the surfaces of the photoconductor drums 2*a*, 2*b*, 2*c*, and 2*d*. The neutralization units 12-0*a*, 12*a*, 12*b*, 12*c*, and 12*d* neutralize electricity (eliminate an electrical charge) of surfaces of the photoconductor drums 2*a*, 2*b*, 2*c*, and 2*d*, before and after the primary transfer, by irradiating the surfaces of the photoconductor drums 2*a*, 2*b*, 2*c*, and 2*d* with light (neutralization light).

A specific configuration of the neutralization units 12-0*a*, 12*a*, 12*b*, 12*c*, and 12*d* is described later.

The cleaning units 11*a*, 11*b*, 11*c*, and 11*d* are disposed so as to face the surfaces of the photoconductor drums 2*a*, 2*b*, 2*c*, and 2*d*, respectively. The cleaning units 11*a*, 11*b*, 11*c* and 11*d* make contact with surfaces of the photoconductor drums 2*a*, 2*b*, 2*c* and 2*d* respectively after transfer of the toner images onto the intermediate transfer belt 7, to thereby clean the surfaces of the photoconductor drum 2*a*, 2*b*, 2*c* and 2*d*. More specifically, the cleaning units 11*a*, 11*b*, 11*c*, and 11*d* remove toner and attached matter remaining on the surface of the photoconductor drums 2*a*, 2*b*, 2*c*, and 2*d*, respectively, and make the removed toner carried to a predetermined collection mechanism for collection.

The secondary transfer roller 8 secondarily transfers the full-color toner image, which has been primarily transferred to the intermediate transfer belt 7, to the paper T. A secondary transfer bias is applied to the secondary transfer roller 8, by a secondary transfer bias application unit (not illustrated). The secondary transfer bias is a bias for transferring the full-color toner image formed on the intermediate transfer belt 7 to the paper T.

The secondary transfer roller 8 is brought into contact with, and spaced apart from, the intermediate transfer belt 7. More specifically, the secondary transfer roller 8 is configured to be movable between a contact position at which it is in contact with the intermediate transfer belt 7 and a spaced position at which it is spaced apart from the intermediate transfer belt 7. In particular, the secondary transfer roller 8 is disposed at the contact position for transferring the toner image primarily transferred to a surface of the intermediate transfer belt 7 to the paper T, and at the spaced position in all other circumstances.

The opposing roller 18 is disposed opposite to the secondary transfer roller 8 across the intermediate transfer belt 7. A predetermined part of the intermediate transfer belt 7 is sandwiched between the secondary transfer roller 8 and the opposing roller 18. The sheet of paper T is pressed against an outer surface (a surface to which the toner image is primarily transferred) of the intermediate transfer belt 7. A secondary transfer nip N2 is formed between the intermediate transfer belt 7 and the secondary transfer roller 8. On the secondary transfer nip N2, the full-color toner image primarily transferred to the intermediate transfer belt 7 is secondarily transferred to the paper T.

The fixing unit 9 fuses and pressurizes color toners composing the toner image secondarily transferred to the paper T, in order to fix the color toners on the paper T. The fixing unit 9 includes a heating rotator 9*a* that is heated by a heater, and a pressurizing rotator 9*b* that is brought into pressure-contact with the heating rotator 9*a*. The heating rotator 9*a* and the pressurizing rotator 9*b* sandwich and pressurize, and convey the paper T to which the toner image is secondarily transferred. The sheet of paper T is fed while sandwiched between the heating rotator 9*a* and the pressurizing rotator 9*b*, so that the toner transferred to the sheet of paper is fused and pressurized to be fixed to the sheet of paper T.

Next, the paper feeding/discharging portion KH is described.

As shown in FIG. 1, a paper feeding cassette 52 as a main accomodate unit for housing the paper T is disposed in a lower portion of the apparatus main body M. The paper feeding cassette 52 is configured to be slidable in a horizontal direction from a housing of the apparatus main body M. The paper feeding cassette 52 includes a paper tray 60 on which the sheets of paper T are placed. The paper feeding cassette 52 stores the sheets of paper T stacked on the paper Tray 60. A sheet of paper T placed on the sheet of paper Tray 60 is fed to the paper feed path L by a cassette feeding unit 51 disposed in an end part of the paper feeding cassette 52 on a side of feeding the sheet of paper (at a right end portion of FIG. 1). The cassette feeding unit 51 includes a double feed prevention mechanism consisting of: a forward feed roller 61 for picking up the paper T on the paper tray 60; and a paper feeding roller pair 81 for feeding the sheet of paper T one by one to the paper feed path L.

The manual feeding unit 64 is provided on a left lateral face (the left side in FIG. 1) of the apparatus main body M. The manual feeding unit 64 is provided in order to feed other sheets of paper T to the apparatus main body M, which are different in size and type from the sheets of paper T stored in the paper feeding cassette 52. The manual feeding portion 64 includes the manual feeding tray 65, which constitutes a portion of a left lateral face of the apparatus main body M in a closed state, and a paper feeding roller 66. A lower end of the manual feeding tray 65 is connected in the vicinity of the paper feeding roller 66, so as to be rotatable (openable and closable). A sheet or sheets of paper T are placed on the manual feeding tray 65 while it is open. The paper feeding roller 66 feeds a sheet of paper T placed on the manual feeding tray 65 while it is open to the manual feeding path La.

The paper feed path L includes: a first paper feed path L1 from the cassette feeding unit 51 to the secondary transfer nip N2; a second paper feed path L2 from the secondary transfer nip N2 to the fixing unit 9; a third paper feed path L3 from the fixing unit 9 to the discharging portion 50; the manual paper feed path La that guides paper fed from the feeding unit 64 to the first paper feed path L1; and a reverse paper feed path Lb that reverses and returns the paper that is fed from a downstream side to an upstream side in the third paper feed path L3 to the first paper feed path L1.

The first paper feed path L1 feeds the paper T stored in the paper feeding cassette 52 toward the image forming portion GK. The manual paper feed path La feeds the paper T stored in the manual feeding portion 64 toward the registration roller pair 80 (described later).

In addition, a first junction P1 and a second junction P2 are provided in the middle of the first paper feed path L1. A first branch portion Q1 is provided in the middle of the third paper feed path L3. The first junction P1 is a junction where the manual paper feed path La joins the first paper feed path L1. The second junction P2 is a junction where the reverse paper feed path Lb joins the first paper feed path L1. The first branch portion Q1 is a branch portion where the reverse paper feed path Lb branches off from the third paper feed path L3.

A paper detection sensor (not illustrated) for detecting the paper T and a registration roller pair 80 are disposed in the middle of the first paper feed path L1 (more specifically, between the second junction P2 and the secondary transfer roller 8). The registration roller pair 80 is designed for skew compensation of the paper T and timing adjustment with respect to formation of the toner image in the image forming portion GK. The paper detection sensor is disposed immediately before the registration roller pair 80 in a conveying direction of the paper T (on an upstream side thereof in the conveying direction). The registration roller pair 80 conveys the paper T while performing the abovementioned compensation and the timing adjustment based on detection information from the paper detection sensor.

A first feeding roller pair 82 as a first roller is disposed between the first junction P1 and the second junction P2 in the first paper feed path L1. The first feeding roller pair 82 is disposed on a downstream side of the paper feeding roller pair 81, and sandwiches and feeds the paper T, which is fed from the paper feeding roller pair 81, to the registration roller pair 80.

For a case of performing duplex printing of the paper T, a reverse paper feed path Lb is provided for making an opposite surface (an unprinted surface), to a surface that has already been printed, face toward the intermediate transfer belt 7. A plurality of second feeding roller pairs 83 that feed the paper T to the second junction P2 is disposed at predetermined intervals in the reverse paper feed path Lb. The reverse paper feed path Lb can reverse and return the paper T, fed from the first branch portion Q1 toward the discharging portion 50, to the first paper feed path L1, in order to feed the paper T to an upstream side of the registration roller pair 80 disposed on an upstream side of the secondary transfer roller 8. At the secondary transfer nip N2, a predetermined toner image is transferred to the unprinted surface of the sheet of paper T that has been reversed by the reverse paper feed path Lb.

A regulating member 58 is provided in the first branch portion Q1. The regulating member 58 regulates a feed direction of the paper T, which is discharged from the fixing unit 9 and fed from the upstream side to the downstream side of the third paper feed path L3, to a direction toward the discharging portion 50. The regulating member 58 regulates a feed direction of the paper T, which is fed from the discharging portion 50 from the downstream side to the upstream side of the third paper feed path L3, to a direction toward the reverse paper feed path Lb.

The discharging portion 50 is formed in an end portion of the third paper feed path L3. The discharging portion 50 is disposed in an upper portion of the apparatus main body M.

The discharging portion 50 has an opening toward a left lateral face of the apparatus main body M (left side in FIG. 1). The discharging portion 50 discharges the paper T to the outside of the apparatus main body M. The discharging portion 50 includes a discharging roller pair 53. The discharging roller pair 53 discharges the paper T, which is conveyed in the third paper feed path L3 from the upstream side to the downstream side, to the outside of the apparatus main body M. The discharging roller pair 53 can feed the paper T toward the upstream side of the third paper feed path L3 by reversing the feed direction of the paper T at the discharging portion 50.

A discharged paper accumulating portion M1 is formed in the vicinity of the opening of the discharging portion 50. The discharged paper accumulating portion M1 is formed on an upper face (outer face) of the apparatus main body M. The discharged paper accumulating portion M1 is a portion of the upper face of the apparatus main body M formed to be dented downward. The bottom face of the discharged paper accumulating portion M1 is composed of a top cover member M2 constituting a part of the upper face of the apparatus main body M. The paper T, on which a predetermined toner image is formed and which is discharged from the discharging portion 50, is stacked and accumulated on the upper face of the top cover member M2 constituting the discharged paper accumulating portion M1. A sensor for detecting a sheet of paper is disposed at a predetermined position of each paper feed path.

Next, operation of the printer 1 according to the embodiment is briefly described with reference to FIG. 1. First, single-side printing on the paper T housed in the paper feeding cassette 52 is described.

The paper T stored in the paper cassette 52 is fed to the first paper feed path L1 by way of the forward feed roller 61 and the paper feeding roller pair 81. And then, the paper T is fed to the registration roller pair 80 by way of the first feeding roller pair 82 via the first junction P1 and the first paper feed path L1. The registration roller pair 80 performs skew compensation of the paper T and timing adjustment with respect to the toner image in the image forming portion GK.

The paper T discharged from the registration roller pair 80 is introduced into between the intermediate transfer belt 7 and the secondary transfer roller 8 (the secondary transfer nip N2) via the first paper feed path L1. A toner image is transferred to the paper T between the intermediate transfer belt 7 and the secondary transfer roller 8. Thereafter, the paper T is discharged from between the intermediate transfer belt 7 and the secondary transfer roller 8, and introduced into the fixing nip between the heating rotator 9*a* and the pressurizing rotator 9*b* in the fixing unit 9 via the second paper feed path L2. Toner is then fused in the fixing nip and fixed onto the paper T.

Subsequently, the paper T is conveyed to the discharging portion 50 via the third paper feed path L3 and discharged from the discharging portion 50 to the discharged paper accumulating portion M1 by the discharging roller pair 53. Single-side printing on the paper T housed in the paper feeding cassette 52 is thus completed.

In a case of single-side printing on the paper T placed on the manual feeding tray 65, the paper T placed on the manual feeding tray 65 is dispatched to the manual paper feed path La by the paper feeding roller 66, and then conveyed to the registration roller pair 80 via the first junction P1 and the first paper feed path L1. Other operations are the same as in the case of single-side printing on the paper T housed in the paper feeding cassette 52, and therefore descriptions thereof are omitted.

Next, operation of the printer 1 performing duplex printing is described.

In a case of single-side printing, as described above, printing is completed by discharging the paper T printed on one side from the paper discharging portion 50 to the discharged paper accumulating portion M1. On the other hand, in a case of duplex printing, the paper T, one side of which has been printed, is reversed via the reverse paper feed path Lb. The paper T is then re-fed to the registration roller pair 80 to thereby complete duplex printing on the paper T.

In more detail, the operation is the same as in the above-mentioned single-side printing until before discharging of the paper T printed on one side from the paper discharging portion 50 by the discharging roller pair 53. In a case of duplex printing, the discharging roller pair 53 stops rotating and rotates again in an opposite direction, in a state of holding the paper T printed on one side. By thus rotating the discharging roller pair 53 in an opposite direction, the paper T held by the discharging roller pair 53 is conveyed in an opposite direction in the third paper feed path L3 (a direction from the paper discharging portion 50 to the first branch portion Q1).

As described above, when the paper T is fed in the opposite direction in the third paper feed path L3, the regulating member 58 directs the paper T to the reverse paper feed path Lb, and then the paper T enters into the first paper feed path L1 via the second junction P2. Here, the paper T is reversed from the orientation thereof in printing on the one side.

Furthermore, the registration roller pair 80 performs the abovementioned compensation or the abovementioned adjustment on the paper T, which is then introduced into the secondary transfer nip N2 via the first paper feed path L1. Since an unprinted surface of the paper T faces the intermediate transfer belt 7 as a result of passing through the reverse paper feed path Lb, a toner image is transferred to the unprinted surface and duplex printing is thus realized.

Figure 3:
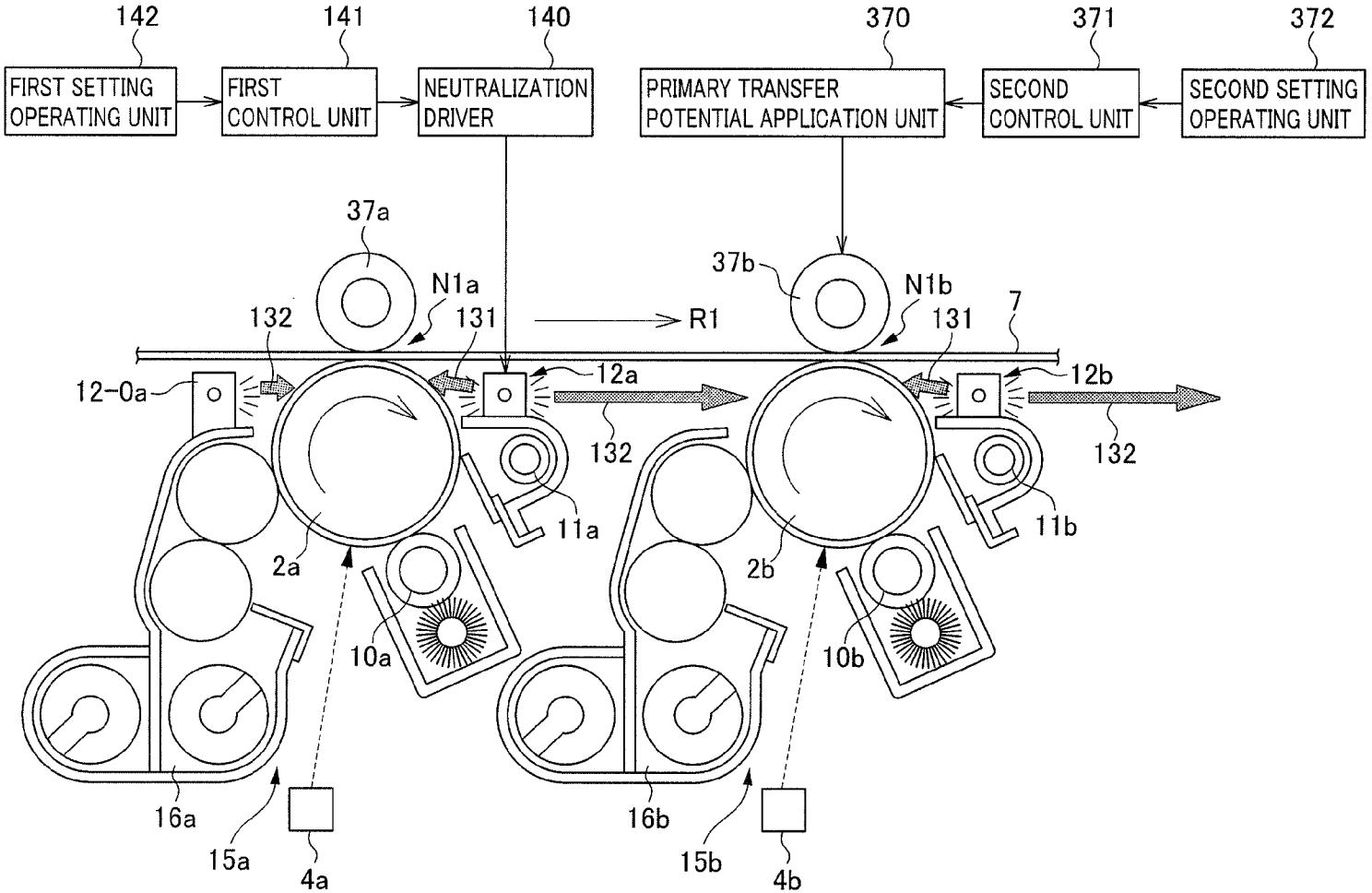
FIG. 3 is an enlarged vertical cross-sectional view illustrating a configuration of two image forming units 15*a*, 15*b* arranged on an upstream side in a rotational direction R1 of an intermediate transfer belt 7, among four image forming units 15*a*, 15*b*, 15*c*, and 15*d*.

Next, the configuration of the neutralization units 12-0*a*, 12*a*, 12*b*, 12*c*, and 12*d* in the four image forming units 15*a*, 15*b*, 15*c*, and 15*d* of the printer 1 according to the embodiment will be described with reference to FIG. 3. FIG. 3 is an enlarged vertical cross-sectional view illustrating a configuration of two image forming units 15*a*, 15*b* arranged on an upstream side in a rotational direction R1 of an intermediate transfer belt 7, among the four image forming units 15*a*, 15*b*, 15*c*, and 15*d*.

As shown in FIGS. 2 and 3, in the four image forming units 15*a*, 15*b*, 15*c*, and 15*d*, the neutralization units 12*a*, 12*b*, 12*c*, and 12*d* are arranged between the primary transfer positions and the cleaning units 11*a*, 11*b*, 11*c*, and 11*d*, respectively. The neutralization unit 12-0*a* is arranged between the primary transfer position and the developing unit 16*a*. The primary transfer positions are positions at which the primary transfer nips N1*a*, N1*b*, N1*c*, and N1*d* are formed in the rotational direction of the photoconductor drums 2*a*, 2*b*, 2*c*, and 2*d*.

The neutralization units 12*a*, 12*b*, 12*c*, and 12*d* irradiate regions on the photoconductor drums 2*a*, 2*b*, 2*c* and 2*d* constituting the four image forming units 15*a*, 15*b*, 15*c*, and 15*d* with first neutralization light 131, the regions spanning from positions facing the primary transfer positions to positions facing the cleaning units 11*a*, 11*b*, 11*c*, and 11*d*, respectively. In addition, the neutralization units 12-0*a*, 12*a*, 12*b* and 12*c* irradiate regions on the photoconductor drums 2*a*, 2*b*, 2*c* and 2*d* constituting the four image forming units 15*a*, 15*b*, 15*c* and 15*d* with the second neutralization light 132, the regions spanning from positions facing the developing units 16*a*, 16*b*, 16*c* and 16*d* and to positions facing the primary transfer positions.

Here, the first neutralization light 131 irradiates regions on the photoconductor drums 2*a*, 2*b*, 2*c* and 2*d* constituting the four image forming units 15*a*, 15*b*, 15*c*, and 15*d*, the regions spanning from positions facing the primary transfer positions to positions facing the cleaning units 11*a*, 11*b*, 11*c*, and 11*d*, respectively. The first neutralization light 131 thereby neutralizes residual charge on the surface of the photoconductor drums 2*a*, 2*b*, 2*c* and 2*d* after the primary transfer of a toner image to the intermediate transfer belt 7 (post-transfer neutralization).

As a result, it is possible to suppress the generation of an exposure memory image due to a difference in surface potential lower than the peripheral potential upon follow-up charging of the exposed part. In addition, it is possible to prevent a part in which the memory image is generated from being printed to be darker than a periphery in a background part.

The second neutralization light 132 irradiates regions on the photoconductor drums 2*a*, 2*b*, 2*c* and 2*d* constituting the four image forming units 15*a*, 15*b*, 15*c*, and 15*d*, the regions spanning from positions facing the developing units 16*a*, 16*b*, 16*c* and 16*d* to positions facing the primary transfer positions, respectively. The second neutralization light 132 performs neutralization such that a dark potential ($V_0$ potential) of a non-image region on the photoconductor drums 2*a*, 2*b*, 2*c* and 2*d* on which toner images have been formed is higher by approximately 100 V than a bright potential ($V_L$ potential) of a solid image region (pre-transfer neutralization).

As a result, with regard to an image region that is a part of the surface of the photoconductor drum where a toner image is formed and a non-image region that is a part of the surface of the photoconductor drum where no toner image is formed, a potential difference between the non-image region and the transfer unit and the potential difference between the image region and the transfer unit are reduced in comparison to a case without the pre-transfer neutralization. As a result, more current flows into the image region, thereby improving the transfer performance. The improvement in the transfer performance allows lowering of the transfer voltage. In addition, this reduces a difference of values of influx current and a difference of charging characteristics between the image region and the non-image region, thereby preventing the generation of transfer memory.

In other words, in the present embodiment, the neutralization unit 12*a* functions as a post-transfer neutralization unit that is disposed between the primary transfer roller 37*a* and the cleaning unit 11*a* and emits the first neutralization light 131 to neutralize the surface of the photoconductor drum 2*a* after transfer, while functioning as a pre-transfer neutralization unit that is disposed between the developing unit 16*b* and the primary transfer roller 37*b* and emits the second neutralization light 132 to neutralize the surface of the photoconductor drum 2*b* before transfer. The same applies to the neutralization units 12*b* and 12*c*.

It should be noted that the post-transfer neutralization unit that emits the first neutralization light 131 and the pre-transfer neutralization unit that emits the second neutralization light 132 can be configured as separate neutralization units.

Figure 4:
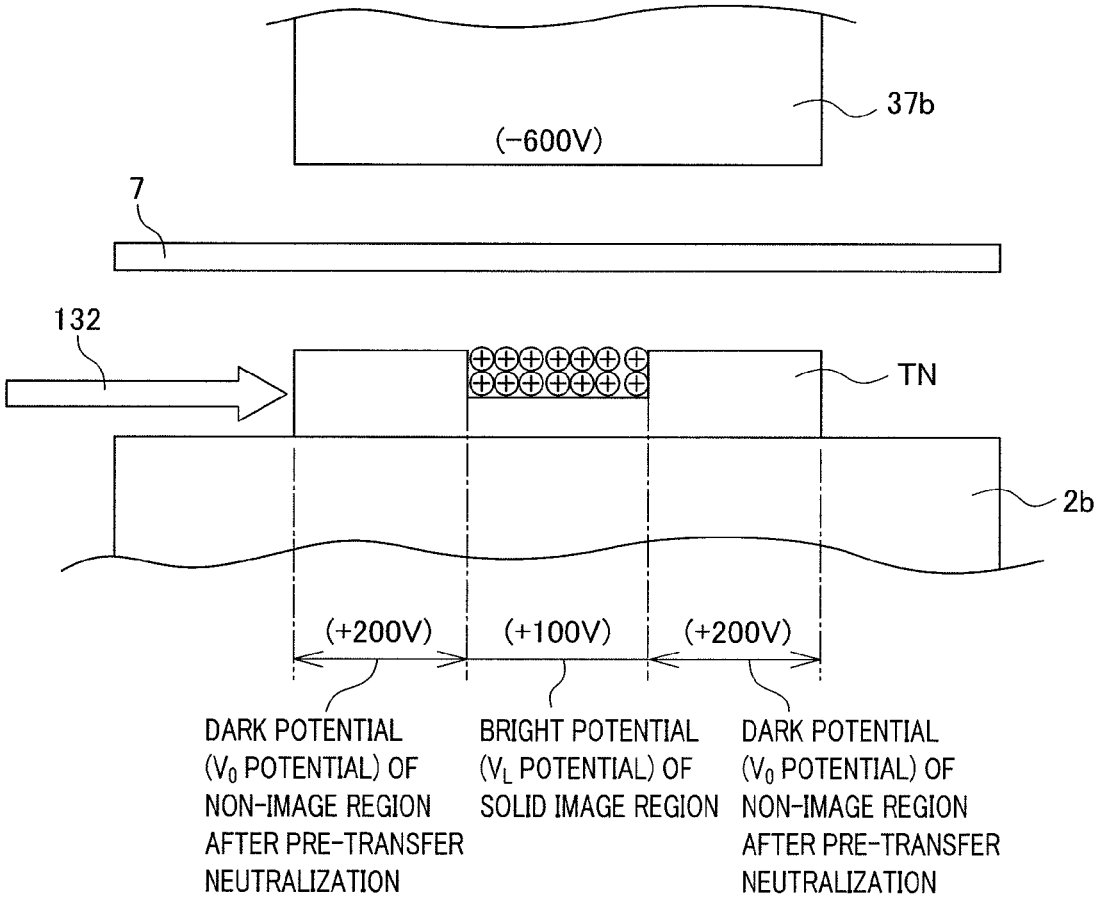
FIG. 4 is a schematic view illustrating a status of a surface potential of a photoconductor drum 2*b* after pre-transfer neutralization by the neutralization unit 12*a* in the printer 1 of the embodiment.

Next, a configuration of a characterizing part of the printer 1 according to the present embodiment is described with reference to FIGS. 3 and 4. FIG. 4 is a schematic view illustrating a status of a surface potential of the photoconductor drum 2*b* after pre-transfer neutralization by the neutralization unit 12*a* in the printer 1 of the embodiment. As described above, the printer 1 is provided with: the five neutralization units 12-0*a*, 12*a*, 12*b*, 12*c* and 12*d*; the four photoconductor drums 2*a*, 2*b*, 2*c* and 2*d*; and the four primary transfer rollers (transfer units) 37*a*, 37*b*, 37*c* and 37*d*. Hereinafter, the neutralization unit 12*a*, the photoconductor drum 2*b*, and the primary transfer roller 37*b* will be described as representative examples. The other neutralization units 12*b*, 12*c* and 12*d*; other photoconductor drums 2*a*, 2*c* and 2*d*; and other primary transfer rollers 37*a*, 37*c* and 37*d* are similarly configured.

For the pre-transfer neutralization of the photoconductor drum 2*b* by the neutralization unit 12*a*, the image forming portion GK includes: a neutralization driver 140 that controls a light emitting behavior of the neutralization unit 12*a*; a first control unit 141 that controls the neutralization light intensity of the neutralization unit 12*a*; and a first setting operating unit 142. The first setting operating unit 142 allows for an increase and decrease of light intensity for the pre-transfer neutralization as appropriate, according to a status of an output image.

More specifically, the neutralization driver 140 controls the neutralization light intensity of the neutralization unit 12*a* based on a light intensity for the pre-transfer neutralization that has been set by the first control unit 141 and the first setting operating unit 142. The neutralization unit 12*a* thus emits the first neutralization light 131. Here, the bright potential ($V_L$ potential) of a solid image region is approximately +100 V, while the dark potential ($V_0$ potential) of a non-image region is +200 V, which is higher than the bright potential ($V_L$ potential) by approximately 100 V.

The "output image" indicates an image that is actually output (toner image), with the influence of transfer memory, scattered toner and the like.

The "solid image region" indicates a region where a solid image is formed as a result of being exposed on the photoconductor drum after charging. The "non-image region" indicates a region where no image is formed (blank) as a result of not being exposed on the photoconductor drum after charging.

The "bright potential ($V_L$ potential)" indicates a potential of the solid image region after charging. The "dark potential ($V_0$ potential)" indicates a potential of the non-image region after charging.

On the other hand, with regard to the primary transfer roller 37*b*, the image forming portion GK includes: a primary transfer potential application unit 370 that applies an intermediate transfer potential to the primary transfer roller 37*b* upon primary transfer to the intermediate transfer belt 7 (image transfer object); a second control unit 371 that controls an applied amount of the intermediate transfer potential; and a second setting operating unit 372 (see FIG. 3).

The second setting operating unit 372 inputs a setting of the intermediate transfer potential. The second control unit 371 controls the transfer potential to be applied to the primary transfer roller 37*b* by the primary transfer potential application unit 370 so as to be a predetermined potential, based on the intermediate transfer potential thus set by the second setting operating unit 372.

More specifically, the second control unit 371 adjusts (controls) the applied amount such that, in a case in which a resistance value of the surface of the primary transfer roller 37*b* to which −1000 V is applied as the intermediate transfer potential is $1\times10^{7\text{-}8.50}\Omega$, a transfer current is in a range of −2.5 to −5.0 μA, based on the intermediate transfer potential being set. The value of the (primary) transfer current (−2.5 to −5.0 μA) corresponds to, for example, 25 to 50% of the value of the (primary) transfer current in a case without the pre-transfer neutralization.

In the printer 1 of the embodiment thus configured, the potential of the non-image region on the photoconductor drum 2*b* is maintained to be higher than the potential of the solid image region by approximately +100 V by the first control unit 141 controlling the neutralization light intensity before transfer, thereby allowing for a reduction in potential difference of the solid image region and the non-image region relative to the primary transfer roller 37*b*. As a result, on the surface of the photoconductor drum 2*b*, scattering of the toner in an edge area of the solid image region toward the periphery of the solid image region is suppressed, whereby transfer performance for fine pixels can be improved.

In addition, the intermediate transfer current is adjusted to be in a range of −2.5 to −5.0 μA, by the second control unit 371 controlling the intermediate transfer potential. As a result, generation of transfer memory due to a difference in the influx amount of the transfer current between the solid image region and the non-image region, due to the potential difference of the solid image region and the non-image region relative to the primary transfer roller 37*b*, is reduced. Especially, even if a charging system of low charging performance that charges the surface of the photoconductor drum 2*b* at a predetermined positive potential, is employed in order to reduce ozone generation and to curb the deterioration in the environment of the installation site of the apparatus such as an office, the generation of the transfer memory can be sufficiently reduced and a clean image without a trace of a previous image can be obtained.

The following test was conducted. The bright potential ($V_L$ potential) of the solid image region on the photoconductor drum 2*b* was set to be +100 V, while the potential of the non-image region on the photoconductor drum 2*b* after the pre-transfer neutralization was set to 4 levels: +600 V; +400 V; +200 V; and +100 V. In addition, the primary transfer current by the primary transfer roller 37*b* was set to 5 levels: −10 μA; −5.0 μA; −3.5 μA; −2.5 μA; and −1.5 μA. Toner scattering, generation of transfer memory, and transfer performance were assessed for cases with and without the pre-transfer neutralization. The results obtained are shown in Table 1.

In the column for toner scattering in Table 1, a circle indicates an absence of toner scattering and an X indicates presence of toner scattering. In the column for transfer memory, XX indicates the generation of extremely large transfer memory; X indicates generation of large transfer memory; a triangle indicates the generation of a little transfer memory; and a combination of a circle and triangle indicates the generation of slight transfer memory. In the column for transfer performance, a circle indicates superior transfer performance; a triangle indicates slightly inferior transfer performance; and X indicates impaired transfer performance.

As is evident from the results shown in Table 1, it was confirmed that the toner scattering can be suppressed to improve the transfer performance, and the generation of transfer memory due to a difference in influx amount of transfer current can be sufficiently reduced to allow formation of a high-quality image, by: the first control unit 141 adjusting the bright potential ($V_L$ potential) of the solid image region to be +100 V and the potential of the non-image region after the pre-transfer neutralization to be +200 V, which is higher than the bright potential ($V_L$ potential) of the solid image region by 100 V, as well as the second control unit 371 adjusting the intermediate transfer current to be in a range of −2.5 μA to −5.0 μA.

The printer 1 of the present embodiment provides, for example, the following effects.

The printer 1 of the present embodiment includes: the charging unit 10*b*; the developing unit 16*b*; the primary transfer roller 37*b*; the neutralization unit 12*a*; the cleaning unit 11*b*; the neutralization unit 12*b*; the first control unit 141; the second control unit 371; and the first setting operating unit 142. The charging unit 10*b* charges the surface of the photoconductor drum 2*b* at a predetermined positive potential. The

TABLE 1

| | Conditions of Drum Potential/Transfer Current/ Pre-transfer Neutralization | | | | Image Performance | | | |
|---|---|---|---|---|---|---|---|---|
| No. | *(1) Bright Potential ($V_L$ Potential) of Solid Image Region [V] | *(2) Dark Potential ($V_0$ Potential) of Non-image Region after Pre-transfer Neutralization [V] | Transfer Current [μA] | Pre-transfer Neutralization | Toner Scattering | Transfer Memory | Transfer Performance | Remarks |
| [1] | +100 | +600 | −10 | NO | ○ | XX | ○ | Transfer Memory Generated |
| [2] | +100 | +400 | −10 | YES | ○ | XX | ○ | Insufficient Improvement of Transfer Memory |
| [3] | +100 | +200 | −10 | YES | ○ | Δ | ○ | Fair Image Quality |
| [4] | +100 | +200 | −5.0 | YES | ○ | ○ | ○ | Fair Image Quality |
| [5] | +100 | +100 | −5.0 | YES | X | Δ | ○ | Excessive Pre-transfer Neutralization, Toner Scattered |
| [6] | +100 | +200 | −3.5 | YES | ○ | ○ | ○ | Optimal Image Quality |
| [7] | +100 | +200 | −2.5 | YES | ○ | ○ | ○ | Fair Image Quality |
| [8] | +100 | +200 | −1.5 | YES | ○ | ○ | Δ | Fair Image Quality |

Conditions
Photoconductor Drum: OPC drum
Drum Charging System: Positive Charging Roller System
Drum Potential Setting: Non-Image Region, Dark Potential ($V_0$ Potential) : +600 V
Solid Image Region, Bright Potential ($V_L$ Potential) : +100 V
General Potential Setting for OPC Drum, Dark Potential ($V_0$ Potential) : +400 to +650 V
Bright Potential ($V_L$ Potential) : +50 to +150 V
*(1) Bright Potential (VL Potential) of Drum in Solid Image Region : +100 V
*(2) Dark Potential of Drum in Non-image Region after Pre-transfer Neutralization
[1] Without pre-transfer Neutralization, transfer memory generated.
[2] Increased neutralization light intensity before transfer. Only insufficient improvement of transfer memory by lowered potential in non-image region.
[3], [4] Preferable conditions in terms of prevention of toner scattering and transfer memory, as well as transfer performance.
[5] Dark potential of non-image region after pre-transfer neutralization being equal to bright potential of solid image region. Toner scattered, Excessive pre-transfer neutralization.
[6] Optimal condition in terms of prevention of toner scattering and transfer memory, as well as transfer performance.
[7], [8] Preferable conditions in terms of prevention toner scattering and transfer memory, as well as transfer performance.

developing unit 16*b* forms a toner image on the surface of the photoconductor drum 2*b* by developing the electrostatic latent image. The primary transfer roller 37*b* is arranged in contact with the surface of the photoconductor drum 2*b* through the intermediate transfer belt 7, and applies a predetermined transfer potential to transfer the toner image to the intermediate transfer belt 7. The neutralization unit 12*a* as the pre-transfer neutralization unit is arranged between the developing unit 16*b* and the primary transfer roller 37*b*, and neutralizes the surface of the photoconductor drum 2*b* before transfer. The cleaning unit 11*b* makes contact with the surface of the photoconductor drum 2*b* after transfer of the toner images onto the intermediate transfer belt 7 to clean the surface of the photoconductor drum 2*b*. The neutralization 12*b* as the post-transfer neutralization unit is arranged between the primary transfer roller 37*b* and the cleaning unit 11*b*, and neutralizes the surface of the photoconductor drum 2*b* after transfer. The first control unit 141 controls the neutralization light intensity of the neutralization unit 12*a* as the pre-transfer neutralization unit such that the dark potential ($V_0$ potential) of the non-image region on the photoconductor drum 2*b* after the pre-transfer neutralization is higher by +50 to +150 V than the bright potential ($V_L$ potential) of the solid image region. The second control unit 371 controls the transfer potential of the primary transfer roller 37*b*. The first setting operating unit 142 allows for an increase and decrease of the neutralization light intensity of the neutralization unit 12*a* as the pre-transfer neutralization unit, based on a status of the output image.

As a result, scattering of the toner in an edge area of the image toward the non-image region can be suppressed; and the transfer memory, which is a trace of a previous image visible on an image currently formed, generated due to a difference in the charging characteristics of the photoconductor drum under the influence of a primary transfer can be prevented.

In addition, by the second control unit 371 controlling the applied amount of the intermediate transfer potential, the intermediate transfer current can be adjusted to reduce a potential difference of the solid image region and the non-image region relative to the primary transfer roller 37*b*. As a result, generation of transfer memory due to a difference in influx amount of the transfer current between the solid image region and the non-image region on the photoconductor drum 2*b* can be reduced.

As described above, adjustment can be made by appropriately combining: adjustment of the potential difference between the solid image region and the non-image region by the first control unit 141; and adjustment of the transfer potential by the second control unit 371. This can suppress scattering of the toner and achieve an improvement of transfer performance, while being a charging system that is preferable for an improvement in the environment. In addition, generation of transfer memory due to a difference in influx amount of the transfer current can be sufficiently reduced, thereby allowing formation of a high-quality clean image without unevenness and inconsistent density.

Furthermore, in the present embodiment, the transfer unit comprises the primary transfer roller 37*b* that rotates in contact with the surface of the photoconductor drum 2*b* through the intermediate transfer belt 7, which is the transfer object, and the charging unit 10*a* comprises a charging roller that rotates in contact with the surface of the photoconductor drum 2*b*. Since the transfer unit and the charging unit are rollers in line contact with the surface of the photoconductor drum 2*b*, degradation of a film on the surface of the photoconductor drum 2*b*, leading to abrasion of the drum, can be suppressed. As a result, durability of the photoconductor drum 2*b* can be improved. Furthermore, this can simplify configurations of, and reduce costs for, the transfer unit and the charging unit.

In the present embodiment, the first control unit 141 controls the neutralization light intensity of the neutralization unit 12*a* as the pre-transfer neutralization unit such that the dark potential ($V_0$ potential) of the non-image region on the photoconductor drum 2*b* after the pre-transfer neutralization is higher by +50 to +150 V than the bright potential ($V_L$ potential) of the solid image region. In addition, the second control unit 371 controls the transfer unit such that, in a case in which a resistance value of the surface of the primary transfer roller 37*b* to which −1000 V is applied as the transfer potential is $1\times10^{7\text{-}8.5}\Omega$, a transfer current corresponding to the transfer potential −600 V is in a range of −2.5 to −5.0 μA.

This can, in the pre-transfer neutralization by the neutralization unit 12*a*, consistently maintain the potential of the non-image region to be higher than that of the solid image region by about +100 V, and adjust the applied amount of the intermediate transfer potential such that the transfer current corresponding to the intermediate transfer potential is maintained in a range of −2.5 to −5.0 μA. As is evident from the test results in Table 1, this can improve the transfer performance by suppressing scattering of the toner, while sufficiently suppressing generation of transfer memory due to a difference in influx amount of transfer current.

A preferred embodiment of the present disclosure has been described above; however, the present disclosure is not limited thereto and can be carried out in various modes.

For example, the image transfer object described in the above embodiment is the intermediate transfer belt 7; however, the present disclosure is not limited thereto. In an image forming apparatus employing a direct transfer system in which an image is directly transferred from the photoconductor drum to an image transfer object without primary transfer, the image transfer object is paper, a film-like sheet, or the like.

The printer 1 is exemplified in the present embodiment as an image forming apparatus; however, the present disclosure is not limited thereto and can be a copy machine, a facsimile machine, or a multi-functional peripheral having functions thereof.

The invention claimed is:

1. An image forming apparatus comprising: an image carrying body that rotates about an axis of rotation and carries a toner image on a surface thereof;

a charging unit that is disposed to face the surface of the image carrying body and electrically charges the surface of the image carrying body at a predetermined positive potential;

an exposure unit that exposes the surface of the image carrying body having been electrically charged by the charging unit to thereby form an electrostatic latent image on the surface;

a developing unit that forms a toner image on the surface of the image carrying body by developing the electrostatic latent image;

a transfer unit that is disposed in contact with the surface of the image carrying body through an image transfer object and transfers the toner image onto the image transfer object by applying a predetermined transfer potential;

a pre-transfer neutralization unit that is disposed between the developing unit and the transfer unit, and partially neutralizes electrical charge of the surface of the image carrying body prior to transfer;

a cleaning unit that contacts the surface of the image carrying body after transfer of the toner image onto the image transfer object to thereby clean the surface of the image carrying body;

a post-transfer neutralization unit that is disposed between the transfer unit and the cleaning unit, and neutralizes electrical charge of the surface of the image carrying body after transfer;

a first control unit that controls neutralization light intensity of the pre-transfer neutralization unit such that a dark potential ($V_0$ potential) of a non-image region on the image carrying body after pre-transfer neutralization is higher by 50 to 150 V than a bright potential ($V_L$ potential) of a solid image region;

a second control unit that controls the predetermined transfer potential of the transfer unit;

a first setting operating unit that allows for an increase and decrease in the neutralization light intensity of the pre-transfer neutralization unit based on a status of an output image; and a second setting operation unit, wherein the transfer unit includes a transfer roller that rotates in contact with the surface of the image carrying body through the image transfer object, wherein the charging unit includes a charging roller that rotates in contact with the surface of the image carrying body, wherein the first control unit controls the neutralization light intensity of the pre-transfer neutralization unit such that a dark potential ($V_0$ potential) of a non-image region on the image carrying body after pre-transfer neutralization is higher by 50 to 150 V than a bright potential ($V_L$ potential) of the solid image region, wherein the second control unit controls the transfer unit such that, in a case in which a resistance value of the surface of the transfer roller to which 1000 V is applied as the transfer potential is $1\times10^{7\text{-}8.5}\Omega$, a transfer current corresponding to the transfer potential is in a range of −2.5 to −5.0 μA, and wherein the second setting operation unit allows for an increase and decrease of a value of the transfer current based on the status of the output image.

* * * * *